US009488165B2

(12) United States Patent
Cho et al.

(10) Patent No.: US 9,488,165 B2
(45) Date of Patent: Nov. 8, 2016

(54) RECIPROCATING COMPRESSOR

(75) Inventors: Sungman Cho, Seoul (KR); Jungsik Park, Seoul (KR); Jongchan Park, Seoul (KR); Sunghyun Ki, Seoul (KR)

(73) Assignee: LG ELECTRONCS INC., Seoul (KR)

( * ) Notice: Subject to any disclaimer, the term of this patent is extended or adjusted under 35 U.S.C. 154(b) by 613 days.

(21) Appl. No.: 13/583,699

(22) PCT Filed: Mar. 14, 2011

(86) PCT No.: PCT/KR2011/001765
§ 371 (c)(1),
(2), (4) Date: Sep. 10, 2012

(87) PCT Pub. No.: WO2011/115398
PCT Pub. Date: Sep. 22, 2011

(65) Prior Publication Data

US 2013/0004343 A1 Jan. 3, 2013

(30) Foreign Application Priority Data

Mar. 15, 2010 (KR) ..... 10-2010-0022984

(51) Int. Cl.
*F04B 39/12* (2006.01)
*F04B 35/04* (2006.01)

(52) U.S. Cl.
CPC ..... *F04B 35/045* (2013.01); *F04B 39/122* (2013.01); *F04B 39/127* (2013.01)

(58) Field of Classification Search
CPC .... F04B 35/045; F04B 17/046; F04B 35/04; F04B 39/12; F04B 39/122; F04B 39/127
USPC ..... 417/417, 418, 416
See application file for complete search history.

(56) References Cited

U.S. PATENT DOCUMENTS

2003/0091449 A1 5/2003 Song et al. ..... 417/417
2005/0140216 A1* 6/2005 Lee ..... 310/12
2006/0017332 A1* 1/2006 Kang et al. ..... 310/15
(Continued)

FOREIGN PATENT DOCUMENTS

CN 1975160 6/2007
KR 10-0273453 12/2000
(Continued)

OTHER PUBLICATIONS

International Search Report issued in PCT Application No. PCT/KR2011/001765 dated Nov. 29, 2011.
(Continued)

*Primary Examiner* — Charles Freay
*Assistant Examiner* — Philip Stimpert
(74) *Attorney, Agent, or Firm* — Ked & Associates, LLP

(57) ABSTRACT

Disclosed is a reciprocating compressor. A cylinder in which a piston makes a reciprocal movement is insertedly coupled to a cylinder part of a frame which fixes a stator of a reciprocating motor, and a collision preventing portion is formed in the cylinder to allow a piston connection portion to collide therewith. Thus, although the piston connection portion overstrokes, the piston connection portion prevent collision force from being transferred to the frame having the cylinder part, whereby a laminated state of the stator can be prevented from being distorted to prevent a degradation of efficiency of the motor, and thus, reliability and performance of the compressor can be enhanced.

11 Claims, 5 Drawing Sheets

(56) References Cited

U.S. PATENT DOCUMENTS

| | | | | |
|---|---|---|---|---|
| 2007/0134116 | A1* | 6/2007 | Park et al. | 417/550 |
| 2007/0166176 | A1* | 7/2007 | Kang et al. | 417/417 |

FOREIGN PATENT DOCUMENTS

| | | |
|---|---|---|
| KR | 10-2002-0073839 | 9/2002 |
| KR | 10-0386277 | 6/2003 |
| KR | 10-2005-0029669 | 3/2005 |
| KR | 10-0511332 | 8/2005 |
| KR | 10-0700555 | 3/2007 |

OTHER PUBLICATIONS

Chinese Office Action dated Jan. 20, 2015.
Korean Office Action dated Jun. 17, 2016 issued in Application No. 10-2010-0022984.

* cited by examiner

RECIPROCATING COMPRESSOR

CROSS-REFERENCE TO RELATED PATENT APPLICATIONS

This application is a U.S. National Stage Application under 35 U.S.C. §371 of PCT Application No. PCT/KR 2011/001765, filed Mar. 14, 2011, which claims priority to Korean Patent Application No. 10-2010-0022984, filed Mar. 15, 2010.

TECHNICAL FIELD

The present invention relates to a reciprocating compressor and, more particularly, to a reciprocating compressor capable of preventing a transfer of impact through a cylinder and blocking a magnetic flux leakage.

BACKGROUND ART

In general, a reciprocating compressor operates based on a scheme in which a piston sucks, compresses, and discharges a refrigerant, while making a reciprocal movement linearly within a cylinder. The reciprocal compressor may be classified into a connection type reciprocating compressor and a vibration type reciprocating compressor depending on a driving scheme of a piston.

In the connection type reciprocating compressor, a piston is connected to a rotational shaft of a rotational motor by a connecting rod and makes a reciprocal movement in a cylinder to compress a refrigerant. Meanwhile, in the vibration type reciprocating compressor, a piston is connected to a mover of a reciprocating motor and makes a reciprocating movement, while vibrating, to compress a refrigerant. The present invention relates to a vibration type reciprocating compressor, and hereinafter, the vibration type reciprocating compressor will be simply referred to as a reciprocating compressor.

In the reciprocating compressor, a piston makes a relatively reciprocal movement in a cylinder in a magnetic flux direction of the reciprocating motor to suck, compress, and discharge a refrigerant, and this sequential process is repeatedly performed.

In the reciprocating compressor, an outer stator and an inner stator of the reciprocating motor are fixed to a frame, so magnetic flux flows between the outer stator and the inner stator through the frame, possibly causing a magnetic flux leakage. Thus, in the related art, the frame is made of a non-magnetic material such as aluminum to prevent a magnetic flux leakage, and also, the cylinder in which the inner stator is inserted is integrally formed with the non-magnetic frame to reduce an iron loss.

DISCLOSURE

Technical Problem

However, in the related art reciprocating compressor, when the piston makes a reciprocal movement by more than a certain range, a portion where the piston and a mover are coupled may collide with a rear end surface of the cylinder. In this case, when the frame and the cylinder are integrally formed as in the related art, impulsive force generated when the piston collides with the cylinder may be transferred to the frame through the cylinder to damage a laminated state of the outer stator and the inner stator coupled to the frame, thus degrading reliability and performance of the compressor.

In addition, when the cylinder is made of an aluminum material used as a material of the frame, the cylinder may be crushed when the piston and the mover collide therewith, and since the piston, assuming a small amount of magnetic flux, makes a reciprocal movement, the inner stator slightly moves according to the reciprocal movement of the piston, and accordingly, a fixing ring inserted into the cylinder to support the inner stator also slightly moves according to the movement of the inner stator, making the cylinder worn down.

Therefore, an object of the present invention is to provide a reciprocating compressor capable of reducing an iron loss of a reciprocating motor, while preventing a transfer of impulsive force to an outer stator and an inner stator, although a piston and a mover collide with a cylinder.

Another object of the present invention is to provide a reciprocating compressor capable of preventing damage to a cylinder by a fixing ring supporting an inner stator of a reciprocating motor when the inner stator is inserted into the cylinder.

Technical Solution

According to an aspect of the present invention, there is provided a reciprocating compressor including: a frame; a reciprocating motor having a stator fixed to the frame and a mover making a reciprocal movement with respect to the stator; a piston coupled to the mover of the reciprocating motor to make a reciprocal movement; and a cylinder fixed to the frame and allowing the piston to be inserted therein to make a reciprocal movement, wherein the frame includes a flange part extending in a radial direction of the piston to support the stator in a movement direction of the piston and a cylinder part formed to extend in the movement direction of the piston and inserted to an outer circumferential surface of the cylinder, wherein a collision preventing portion is formed on an upper end of the cylinder to prevent the mover and the piston to collide with the cylinder part of the frame while making a reciprocal movement.

Advantageous Effects

According to embodiments of the present invention, in the reciprocating compressor, the cylinder in which the piston makes a reciprocal movement is inserted into and combined with the cylinder part of the frame that fixes the stator of the reciprocating motor, and the collision preventing portion is formed on the cylinder such that the piston connection portion collides with collision preventing portion, whereby although the piston connection portion performs an overstroke, impulsive force is prevented from being transferred to the frame having the cylinder part, preventing a laminated state of the stator from being distorted, and thus, a degradation of efficiency of the motor is prevented and reliability and performance of the compressor can be increased.

BEST MODES

A reciprocating compressor and refrigeration equipment according to embodiments of the present invention will be described in detail with reference to the accompanying drawings.

Figure 1:
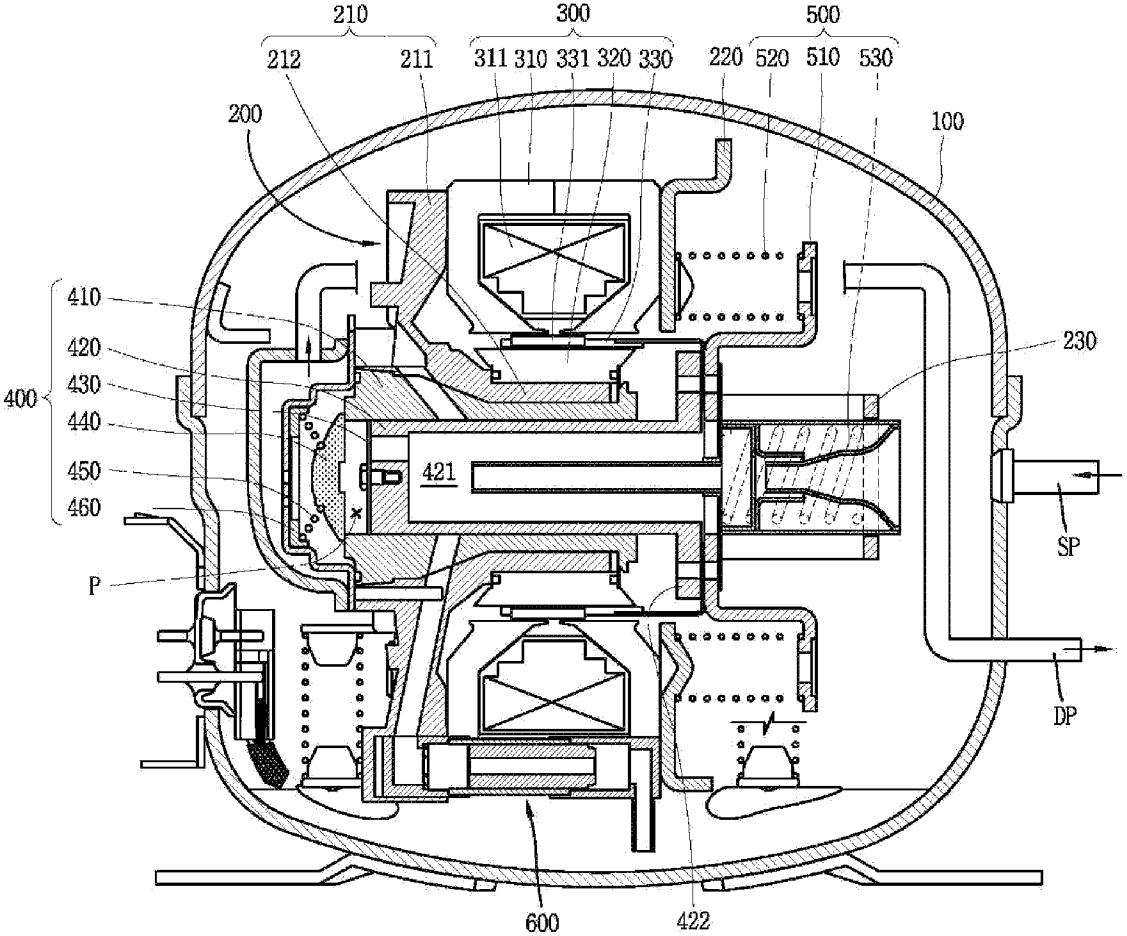
FIG. 1 is a vertical sectional view showing a reciprocating compressor according to an embodiment of the present invention.

As shown in FIG. 1, a reciprocating compressor according to an embodiment of the present invention includes a casing 100 to which a gas suction pipe SP and a gas discharge pipe DP are connected, a frame unit 200 elastically supported within the casing 100, a reciprocating motor 300 supported by the frame unit 200 and having a mover 330 makes a linear reciprocal movement as described hereinafter, a compression unit 400 having a piston 420 (to be described) coupled to the mover 330 of the reciprocating motor and supported by the frame unit 200, and a plurality of resonance units 500 elastically supporting the mover 330 of the reciprocating motor 300 and the piston 420 of the compression unit 400 to induce a resonant movement.

The frame unit 200 includes a first frame 210 supporting the compression unit 400 and a front side of the reciprocating motor 300, a second frame 220 coupled to the first frame 210 and supporting a rear side of the reciprocating motor 300, and a third frame 230 coupled to the second frame 220 to support a plurality of second resonance springs 530 (to be described). The first frame 210, the second frame 220, and the third frame 230 may be made of a non-magnetic material such as aluminum to reduce iron loss.

In the first frame 210, a frame part 211 is formed to have an annular plate shape and extend in a radial direction with respect to a movement direction of the piston 420, and a cylinder part 212 is integrally formed to extend to a rear side, namely, toward the reciprocating motor such that a cylinder 410 is inserted at the center of the frame part 211. The frame part 211 may be formed such that an outer diameter thereof is not at least smaller than an inner diameter of an outer stator 310 of the reciprocating motor 300 in order to support both the outer stator 310 and the inner stator 320 of the reciprocating motor 300 (to be described).

Since the inner stator 320 is insertedly fixed to an outer circumferential surface of a cylinder part 212, the first frame 210 may be made of a non-magnetic material such as aluminum to prevent a loss of magnetic force. The cylinder part 212 may be integrally formed in the cylinder 410 (to be described) through an insert-dicasting technique. However, the cylinder 410 may be press-fit to an inner circumferential surface of the cylinder part 212 or the inner circumferential surface of the cylinder part 212 may be threaded to screw-assemble the cylinder 410. The cylinder part 212 may have a step surface or a sloped surface between a front inner circumferential surface and a rear inner circumferential surface to allow the cylinder 410 coupled to the inner circumferential surface of the cylinder part 212 to be supported in the direction of the piston, and this may be desirous in terms of stability of the cylinder 410.

The reciprocating motor 300 includes an outer stator 310 supported between the first frame 210 and the second frame 220 and having a coil 311 wound therearound, an inner stator 320 coupled to an inner side of the outer stator 310 with a certain gap therebetween and insertedly positioned in the cylinder part 212, and a mover 330 including a magnet 331 corresponding to the coil 311 of the outer stator 310 and making a linear reciprocal movement in a magnetic flux direction between the outer stator 310 and the inner stator 320. The outer stator 310 and the inner stator 320 may be formed by laminating a plurality of sheets of thin stator cores to have a cylindrical shape or by laminating a plurality of sheets of thin stator cores to have a block shape and radially laminating the stator blocks.

The compression unit 400 includes a cylinder 410 integrally formed with the first frame 210, a piston 420 coupled to the mover 330 of the reciprocating motor 300 and making a reciprocal movement in the compression space P of the cylinder 410, a suction valve 430 installed on a front end of the piston 420 and adjusting suction of a refrigerant gas by opening and closing a suction flow path 421 of the piston 420, a discharge valve 440 installed at a discharge side of the cylinder 410 and adjusting discharging of a compression gas by opening and closing the compression space P of the cylinder 410, a valve spring 450 elastically supporting the discharge valve 440, and a discharge cover 460 fixed to the first frame 210 at the discharge side of the cylinder 410 such that the discharge valve 440 and the valve spring 450 are accommodated.

The cylinder 410 has a cylindrical shape and is insertedly coupled to the cylinder part 212 of the first frame 210.

The cylinder 410 forms a bearing surface with the piston 420 having an inner circumferential surface made of cast iron, and in order to avoid abrasion of the cylinder 410 by the piston 420, the cylinder 410 is made of cast iron or a material having higher hardness than that of the first frame, more specifically, the cylinder part 212.

The piston 420 may be made of the same material as that of the cylinder 410 or may be made of a material having hardness which is at least similar to that of the cylinder 410. The suction flow path 421 is formed to penetrate the interior of the piston 420 to allow a refrigerant to be sucked into the compression chamber P of the cylinder 410.

The resonance unit 500 includes a mover 330, a spring supporter 510 coupled to a connection portion of the piston 420, first resonance springs 520 supported by a front side of the spring supporter 510, and second resonance springs 530 supported by a rear side of the spring supporter 510.

Reference numeral 422 denotes a piston connection portion and 600 is an oil feeder.

The reciprocating compressor configured as described above operates as follows.

When power is applied to the reciprocating motor 300 and magnetic flux is formed between the outer stator 310 and the inner stator 320, the mover 330 placed in an air gap between the outer stator 310 and the inner stator 320 moves in a direction of the magnetic flux and continuously makes a reciprocal movement by the resonance unit 500. When the piston 420 makes a backward movement within the cylinder 410, the refrigerant filled in the internal space of the casing 100 is sucked into the compression space P of the cylinder 410 through the suction flow path 421 of the piston 420 and the suction valve 430. When the piston 420 makes a forward movement within the cylinder 410, the refrigerant gas sucked into the compression space P is compressed to open the discharge valve 440 so as to be discharged. This sequential process is repeatedly performed.

Here, if magnetic flux generated in the reciprocating motor 300 is formed only between the outer stator 310 and the inner stator 320 of the reciprocating motor 300, the reciprocating motor 300 may have the highest efficiency, but in terms of structural characteristics of the reciprocating compressor, the first frame 210, the second frame 220, the cylinder 410, and the like, are positioned in the vicinity of the outer stator 310 and the inner stator 320. Thus, in order to increase efficiency of the reciprocating motor 300, a leakage of magnetic flux of the reciprocating motor 300 to the first frame 210, the second frame 220, and the cylinder 410 should be minimized.

To this end, the first frame 210, the second frame 220, and the cylinder 410 may be made of an aluminum material as a non-magnetic material. However, in the case of the cylinder 410, it is slidably in contact with the piston 420 made of cast iron, having a high possibility of being abraded, so abrasion of the cylinder 410 by the piston 420 should be prevented, as well as reducing a leakage of magnetic flux.

Figure 5:
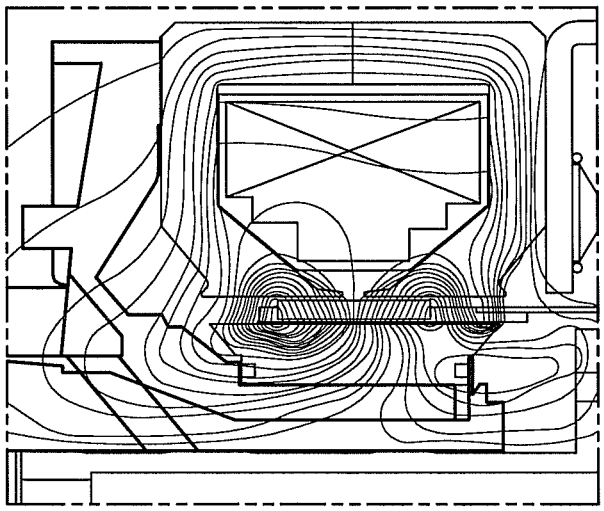
FIG. 5 is a view showing a magnetic force line distribution around a reciprocating motor in the reciprocating compressor of FIG. 1.

Thus, in an embodiment of the present invention, the cylinder 410 forming a bearing surface with the piston 420 is made of a magnetic material having high hardness to reduce abrasion with respect to the piston 420 and the cylinder part 212 of the first frame 210 in contact with the inner stator is made of a non-magnetic material, thus preventing magnetic flux leaked to the cylinder 410 and reducing an iron loss of the motor as shown in FIG. 5

In this case, however, when a rear end of the cylinder part 212 of the first frame 210 and a rear end of the cylinder 410 are the same or when the rear end of the cylinder part 212 is tightly attached to the rear end of the cylinder 410, if a portion (referred to as a 'piston connection portion', hereinafter) in which the piston 420 is connected to the mover 330 are connected collides with the cylinder 410, corresponding impact is transferred to the flange part 211 of the first frame 210 through the cylinder part 212 of the first frame 210 to crack the laminated structure of the outer stator 310 or the inner stator 320. In order to prevent this, in the present embodiment, among the cylinder part 212 and the cylinder 410, the rear end of the cylinder 410 having relatively high hardness is formed to be longer than the rear end of the cylinder part 212, whereby the piston connection portion 422 is prevented from directly colliding with the cylinder part 212 or transmission of impact is prevented.

Figure 2:
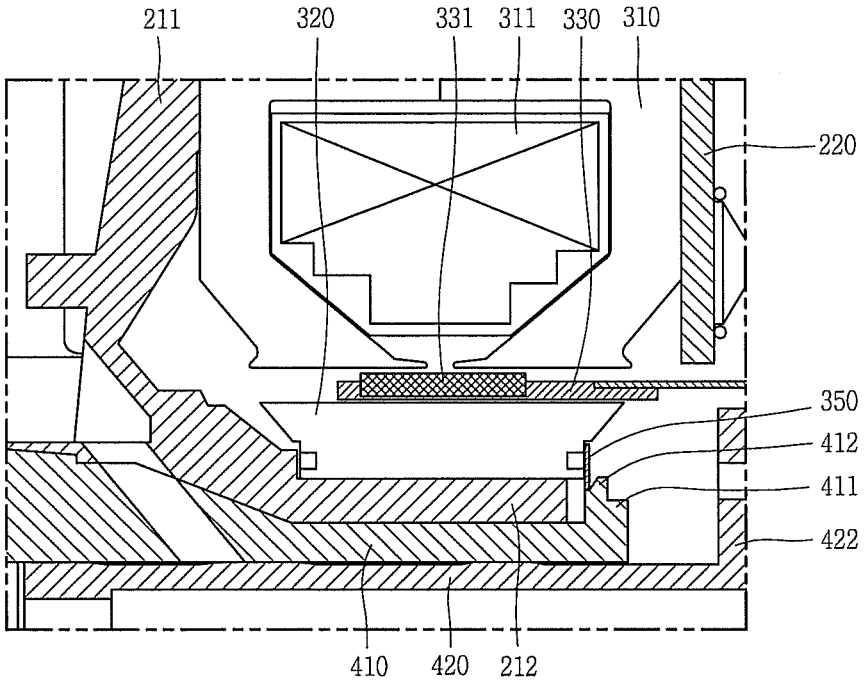
FIG. 2 is a vertical sectional view showing a cylinder and a cylinder part of the reciprocating compressor of FIG. 1.
Figure 3:
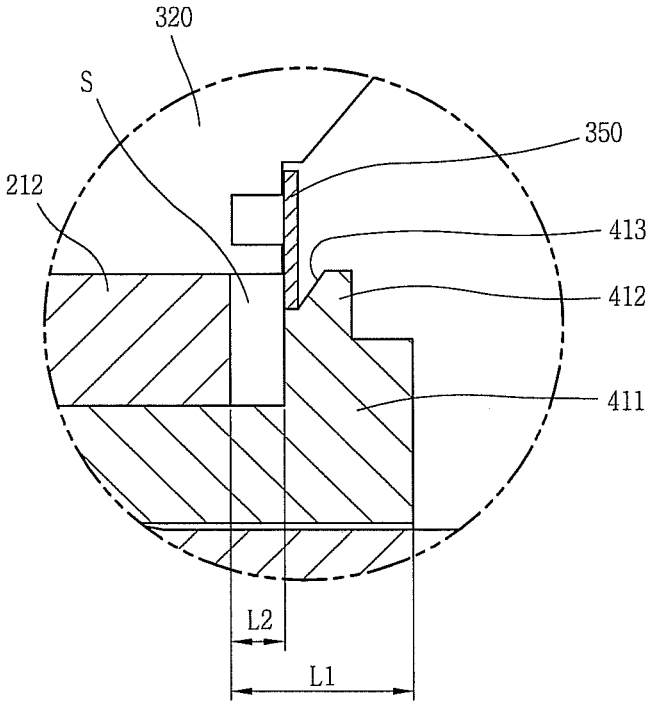
FIG. 3 is a vertical sectional view of a collision preventing portion in FIG. 2.

In detail, as illustrated in FIGS. 2 and 3, a collision preventing portion 411 is formed in the rear side of the cylinder 410 in order to prevent the mover 330 and the piston connection portion 422 from colliding with the cylinder 410.

As mentioned above, the collision preventing portion 411 is formed on a rear portion of the cylinder 410 such that it is protruded more than a rear end of the cylinder part 212 by a certain length L1 toward the piston connection portion 422. Namely, the collision preventing portion 411 is protruded further than the rear end portion of the cylinder part 212 in order to prevent the piston connection portion 422 from colliding with the cylinder part 212 when the piston 420 overstrokes.

A ring fixing portion 412 having a certain height is formed on an outer circumferential surface of the collision preventing unit 411, to which a fixing ring 350 (to be described) is coupled. Preferably, the ring fixing portion 412 is formed to have a sloped surface 413 increased in height toward the rear side such that the fixing ring 350 hinders the inner stator 320 from moving in a forward direction (i.e., a reciprocal direction of the piston) upon being attracted by the piston 420 having fine magnetic force when the piston 420 makes a reciprocal movement.

Figure 4:
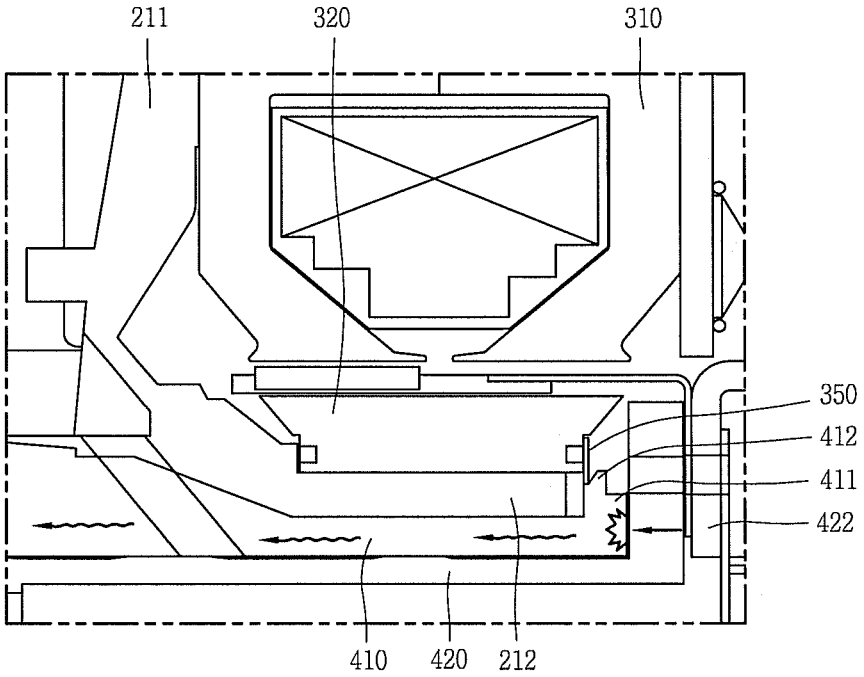
FIG. 4 is a schematic view showing a transmission path of impact when a piston connection portion collides with a cylinder in FIG. 2.

The lowermost end of the sloped surface 413 and the rear end surface of the cylinder part 212 are spaced apart by a certain distance L2 to form a buffer portion S, whereby although the piston connection portion 422 collides with the end of the cylinder 410, namely, the ring fixing portion 412, collision force is prevented from being transferred to the cylinder part 212 as shown in FIG. 4.

In this manner, in the reciprocating compressor, since the cylinder in which the piston makes a reciprocal movement is inserted into and combined with the cylinder part of the frame that fixes the stator of the reciprocating motor and the collision preventing portion is formed on the cylinder such that the piston connection portion collides with collision preventing portion, although the piston connection portion performs an overstroke, impulsive force is prevented from being transferred to the frame having the cylinder part, preventing a laminated state of the stator from being distorted, and thus, a degradation of efficiency of the motor is prevented and reliability and performance of the compressor can be increased.

[Mode for Invention]

Another example of the ring fixing portion of the cylinder will be described.

Figure 6:
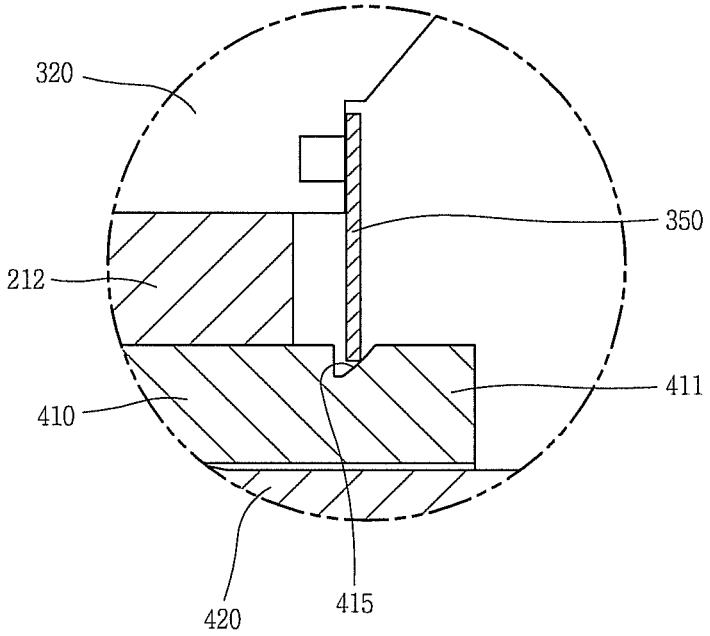
FIG. 6 is a vertical sectional view showing another example of a fixing ring fixing structure in the reciprocating compressor of FIG. 1.

In the foregoing embodiment, in order to fix the fixing ring, a ring fixing portion having a certain height is formed in the collision preventing portion of the cylinder, but in the present embodiment, as shown in FIG. 6, a ring fixing portion is not formed to be protruded in the collision preventing portion 411 of the cylinder, but a ring fixing recess 415 is formed. In this case, in order to more firmly fix the inner stator 320, the ring fixing recess 415 may have a sloped surface as in the former embodiment describe above.

Meanwhile, an application of the reciprocating compressor to refrigeration equipment can improve efficiency of the refrigeration equipment.

Figure 7:
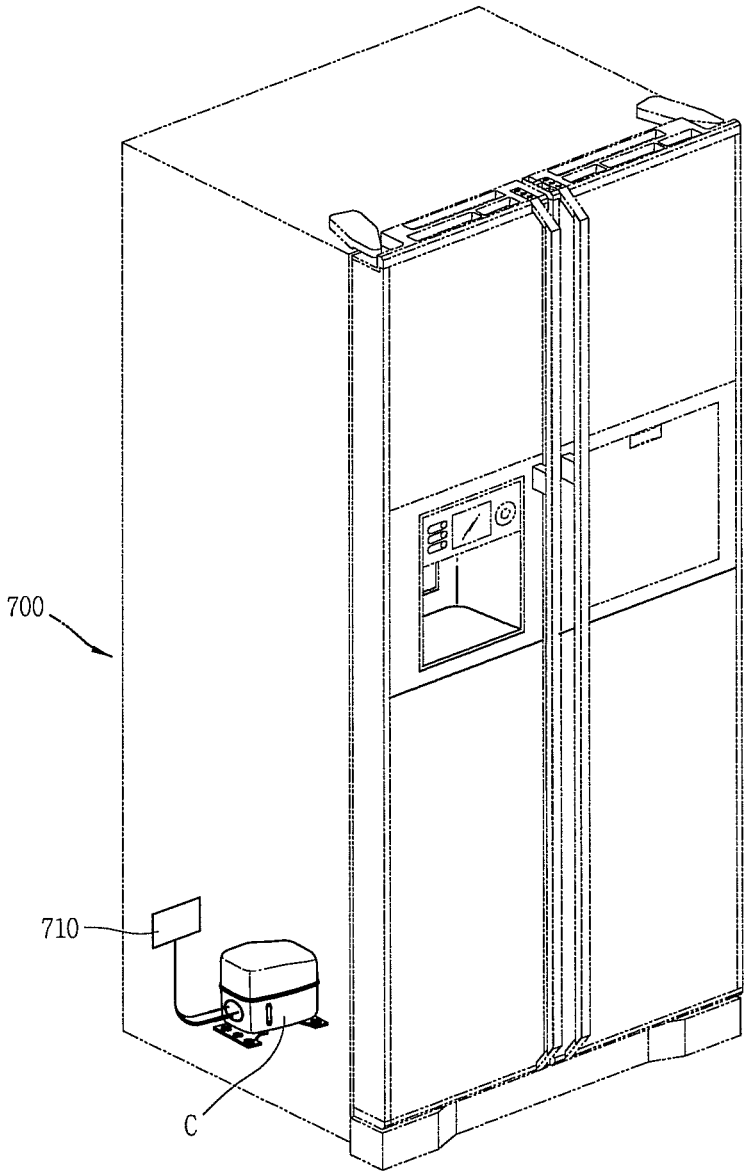
FIG. 7 is a perspective view showing an example of a refrigerator employing a reciprocating compressor according to an embodiment of the present invention.

For example, as shown in FIG. 7, in refrigeration equipment 700 having a refrigerant compression type refrigerating cycle including a compressor, a condenser, an expander, and an evaporator, the reciprocating compressor C may be connected to a main board 710 which generally controls an operation of the refrigeration equipment, and a cylinder installed within the reciprocating compressor C may be formed to have a dual-structure including a cylinder as a magnetic body and a cylinder part extending from the first frame as a non-magnetic body like in the foregoing embodiments. Also, a collision preventing portion may be formed on a rear end of the cylinder to prevent the piston connection portion from colliding with the cylinder part or collision force is prevented from being transferred to the frame, thereby enhancing reliability and performance of the compressor.

In this manner, abrasion between the cylinder and piston in the compressor is prevented to enhance reliability of the compressor and a leakage of magnetic force from the reciprocating motor to the cylinder is prevented to enhance efficiency of the compressor, and thus, energy efficiency of the refrigeration equipment employing the reciprocating compressor can be enhanced.

INDUSTRIAL APPLICABILITY

The reciprocating compressor according to an embodiment of the present invention can be extensively used in refrigeration equipment such as a refrigerator, an air-conditioner, or the like.

The invention claimed is:

1. A reciprocating compressor, comprising:

a frame;

a reciprocating motor having a stator fixed to the frame and a mover that makes a reciprocal movement with respect to the stator, wherein the stator includes an outer stator and an inner stator formed to be spaced apart from each other by a predetermined gap in a radial direction, and wherein the mover makes the reciprocal movement between the outer stator and the inner stator;

a piston coupled to the mover of the reciprocating motor to make the reciprocal movement; and a cylinder fixed to the frame, wherein the piston is inserted into the cylinder to make the reciprocal movement, wherein the frame includes a flange that extends in a radial direction of the piston to support the outer stator and the inner stator in a movement direction of the piston and a cylinder portion that extends in the movement direction of the piston, wherein the cylinder portion is integrally formed with the flange and inserted onto an outer circumferential surface of the cylinder, wherein the inner stator is insertedly fixed to an outer circumferential surface of the cylinder portion of the frame, wherein a collision preventing portion is formed on an end of the cylinder opposite to the flange in the movement direction of the piston to prevent the mover and the piston from colliding with the cylinder portion of the frame and the inner stator, wherein the mover and the piston collide with the collision preventing portion of the cylinder when the piston performs an overstroke while making the reciprocal movement, wherein the piston is connected to the mover at a piston connection portion, and wherein the collision preventing portion protrudes farther than an end of a piston connection portion side of the cylinder portion of the frame and an end of the piston connection portion side of the inner stator in the movement direction of the piston, the end being a point of furthest extent of the piston connection portion side of the inner stator in the movement direction of the piston wherein a protrusion having an outer diameter greater than an inner diameter of the cylinder portion is monolithically formed on an outer circumferential surface of the collision preventing portion, and wherein a support member is coupled to the protrusion, that supports the inner stator in a direction in which the piston makes the reciprocal movement.

2. The reciprocating compressor of claim 1, wherein a lateral surface of the protrusion and the end of the cylinder portion are spaced apart from each other by an empty space having a predetermined length in the movement direction of the piston.

3. The reciprocating compressor of claim 1, wherein a fixing recess is formed on an outer circumferential surface of the collision preventing portion such that a support member that supports the inner stator in the movement direction of the piston is supported therein.

4. The reciprocating compressor of claim 1, wherein the cylinder is made of a material having a hardness strength stronger than a hardness strength of the frame.

5. The reciprocating compressor of claim 1, wherein the frame is made of a non-magnetic material.

6. A refrigerator comprising the reciprocating compressor of claim 1.

7. A reciprocating compressor, comprising:

a frame elastically supported within a casing and having a cylinder portion;

an outer stator and an inner stator fixed to the frame and formed to be spaced apart from each other by a predetermined gap in a radial direction, wherein the inner stator is insertedly fixed to the outer circumferential surface of the cylinder portion of the frame;

a mover provided to make a reciprocal movement between the outer stator and the inner stator;

a piston having a piston connection portion coupled to the mover, that makes the reciprocal movement together with the mover; and a cylinder insertedly fixed to the cylinder portion of the frame and having the piston inserted therein such that the piston makes the reciprocal movement therein, wherein a collision preventing portion is formed on an end of the cylinder, wherein the collision preventing portion protrudes toward the piston connection portion farther than an end of a piston connection portion side of the cylinder portion of the frame and an end of the piston connection portion side of the inner stator in a movement direction of the piston, wherein the end of the piston connection portion side of the inner stator is a point of furthest extent of the piston connection portion side of the inner stator in the movement direction of the piston, wherein a buffer space is provided between the end of the cylinder and the end of the cylinder portion, wherein a protrusion having an outer diameter greater than an inner diameter of the cylinder portion is monolithically formed on an outer circumferential surface of the collision preventing portion, wherein a support member is coupled to the protrusion and supports the inner stator in the movement direction of the piston, and wherein the buffer space is formed between a lateral surface of the protrusion and the end of the cylinder portion, which are spaced apart from each other by a predetermined distance to form an empty state that constitutes the buffer space.

8. The reciprocating compressor of claim 7, wherein the cylinder is insertedly coupled to the cylinder portion of the frame in the movement direction of the piston, and wherein the cylinder portion is integrally formed with a flange of the frame.

9. The reciprocating compressor of claim 8, wherein the cylinder is made of a material having a hardness strength stronger than a hardness strength of the frame.

10. The reciprocating compressor of claim 8, wherein the frame is made of a non-magnetic material.

11. A refrigerator comprising the reciprocating compressor of claim 7.

* * * * *